US005316446A

United States Patent [19]

Kimura et al.

[11] Patent Number: 5,316,446

[45] Date of Patent: May 31, 1994

[54] VARIABLE CAPACITY WOBBLING SWASH PLATE TYPE COMPRESSING APPARATUS

[75] Inventors: Kazuya Kimura; Hiroaki Kayukawa, both of Kariya, Japan

[73] Assignee: Kabushiki Kaisha Toyoda Jidoshokki Seisakusho, Kariya, Japan

[21] Appl. No.: 945,969

[22] PCT Filed: Mar. 26, 1992

[86] PCT No.: PCT/JP92/00370

§ 371 Date: Nov. 3, 1992

§ 102(e) Date: Nov. 3, 1992

[87] PCT Pub. No.: WO92/17704

PCT Pub. Date: Oct. 15, 1992

[30] Foreign Application Priority Data

Mar. 26, 1991 [JP] Japan ..... 3-062093

[51] Int. Cl.[5] ..... F04B 27/08

[52] U.S. Cl. ..... 417/269; 417/222.1; 74/60; 92/12.2

[58] Field of Search ..... 74/60; 417/222.1, 222.2, 417/269, 270; 92/12.2

[56] References Cited

U.S. PATENT DOCUMENTS

| | | | |
|---|---|---|---|
| 2,570,843 | 10/1951 | Orshansky | 92/12.2 |
| 4,586,874 | 5/1986 | Hiraga | 417/222.2 |
| 4,664,604 | 5/1987 | Terauchi | 417/222.2 |
| 4,932,843 | 6/1990 | Itoigawa et al. | 417/222.1 |
| 5,105,728 | 4/1992 | Hayase et al. | 417/222.2 |
| 5,167,492 | 12/1992 | Kent et al. | 417/222.2 |
| 5,173,032 | 12/1992 | Taguchi | 417/222.2 |
| 5,174,728 | 12/1992 | Kimura et al. | 417/222.2 |

FOREIGN PATENT DOCUMENTS

| | | | |
|---|---|---|---|
| 60-135680 | 7/1985 | Japan . | |
| 0171886 | 8/1986 | Japan | 417/222.2 |
| 641668 | 1/1989 | Japan . | |

*Primary Examiner*—Richard A. Bertsch
*Assistant Examiner*—Peter Korytnyk
*Attorney, Agent, or Firm*—Brooks Haidt Haffner & Delahunty

[57] ABSTRACT

A variable capacity wobbling swash plate type compressing apparatus is provided with a housing (10), and a cylinder block (12) arranged in the housing; the cylinder block being provided with cylinder bores arranged radially with respect to the central axis of the housing and equidistantly to one another; the cylinder bores receiving therein pistons (16) to be slidable therein. A drive shaft (20) is arranged in a crank chamber (18) so as to extend along the central axis of the housing, and supports thereon a swash plate (40, 44) capable of wobbling about an axis perpendicular to a longitudinal axis of the drive shaft, and shoes (22) are arranged between the swash plate and the pistons for converting a rotation of the swash plate into reciprocation of the respective pistons. A rotary drive member (50) is fixedly mounted on the drive shaft to support thereon a bearing element (52*b*) for transmitting a rotation of the rotary drive member to the swash plate; the bearing element being provided with a connecting pin element (52*c*) extending from the swash plate and slidably engaged with the bearing element. The shoes and the bearing element are arranged in substantial alignment with center lines (CL) of the respective pistons, and this arrangement is unchanged even when an angle of inclination of the swash plate is changed so as to vary the compression capacity of the pistons.

5 Claims, 8 Drawing Sheets

VARIABLE CAPACITY WOBBLING SWASH PLATE TYPE COMPRESSING APPARATUS

TECHNICAL FIELD

The present invention relates to a variable capacity wobbling swash plate type compressing apparatus, and more particularly, to a variable capacity wobbling swash plate type compressing apparatus suitable for use in an air-conditioning system of an automobile.

BACKGROUND ART

Japanese Unexamined (Kokai) Patent Publication No. 60-175783 and Japanese Unexamined (Kokai) Utility Model Publication No. 62-183082 disclose a typical wobble plate type variable capacity compressing apparatus. The disclosed apparatus is provided with a housing, a cylinder block housed in the housing and a drive shaft arranged so as to axially extend along the longitudinal axis of the housing. The cylinder block has a plurality of cylinder bores that are arranged radially with respect to the axis of the drive shaft and equidistantly to one another. Each of the cylinder bores is communicated with suction and discharge chambers, respectively, via respective reed valves. The suction and discharge chambers of the compressor communicate with a condenser and an evaporator of an air-conditioner of an automobile, respectively.

Each of the cylinder bores receives a piston to be reciprocated therein, and during the suction stroke of the piston, a refrigerant gas sent from the condenser to the suction chamber enters the cylinder bores via the reed valves. The refrigerant gas is subsequently compressed in the cylinder bores during the compressing stroke of the pistons, and the compressed refrigerant is discharged toward the discharge chamber via the reed valves. The compressed refrigerant is then delivered from the discharge chamber of the compressor to the evaporator of the air-conditioning system.

In order to reciprocate the pistons in the cylinder bores, a swash plate is arranged, in a crank chamber of the housing so as, to be slidably engaged with the pistons. Namely, the swash plate is engaged with pistons in a manner such that the rotation of the swash plate causes reciprocation of the pistons. The swash plate is supported and slidable with respect to the drive shaft, and can wobble about an axis perpendicular to the axis of the drive shaft. Further, the angle of inclination of the swash plate can be adjustably changed to control the stroke of the pistons, i.e., the compression capacity of the compressor.

The swash plate is connected to a rotary drive member fixed to the drive shaft via a hinge means to thereby obtain a drive force from the drive shaft, and the hinge means includes a connecting pin element supported by the swash plate. The connecting pin element is engaged in an elongated arcuate hole formed in the rotary drive element. The connecting pin element of the hinge means is moved in the arcuate hole when the angle of inclination of the swash plate is adjusted, and acts as a fulcrum about which the swash plate is moved to change the angle of inclination thereof.

The adjustment of the angle of inclination of the swash plate is performed by changing the pressure level of the refrigerant gas prevailing in the crank chamber, which is in fluid communication with the suction chamber and/or the discharge chamber via an appropriate control valve. Namely, when the pressure level in the crank chamber is lowered by the control valve, pressure acting on the back of each piston is lowered to increase the angle of inclination of the swash plate to thereby expand the stroke of each piston. As a result, the compression capacity of the compressor increases.

On the contrary, when the pressure level within the crank chamber is increased by the control valve, the pressure acting on the back of each piston is accordingly increased to reduce the piston stroke thereby decreasing the angle of inclination of the swash plate. Thus, the compression capacity of the compressor becomes small.

As described above, when the swash plate is moved so as to change the angle of inclination thereof, the movement of the swash plate is conducted with respect to the fulcrum provided by the connecting pin element of the hinge means, and the fulcrum per se moves in response to a change in the angle of inclination of the swash plate. More specifically, in the conventional variable capacity wobbling swash plate type compressor, when the swash plate is moved to the largest inclination angle position thereof, i.e., when the stroke of the pistons is fully extended a specific point of action, where a reaction force due to compression of the refrigerant gas is given by the piston to the swash plate, and the position of the connecting pin element (i.e., the fulcrum of the movement of the swash plate) are in alignment with the center axis of one of the pistons.

Nevertheless, when the angle of inclination of the swash plate is reduced, the connecting pin element is shifted from the aligned position to a position below the above-mentioned specific point of action, and therefore, the reaction force due to the compression of the refrigerant gas produces a rotary moment acting on the swash plate so as to rotate it about the connecting pin element. Namely, the above-mentioned rotary moment provides the swash plate with a further reduction in the angle of inclination thereof, and accordingly, a response to the control operation of the control valve for reducing the angle of inclination of the swash plate to thereby reduce the compression capacity becomes extra-sensitive.

On the contrary, when the control operation is carried out to increase the angle of inclination of the swash plate from the smallest inclination angle position so as to obtain a large compression capacity, a response to the control operation is not sensitive.

Further, in the above-mentioned conventional variable capacity wobbling swash plate type compressor, with the afore-mentioned elongated arcuate hole of the rotary drive element for receiving the connecting pin element it is very difficult to obtain an accurate formation thereof by machining. If an accurate formation of the arcuate hole fails, a change in the top clearance of respective pistons occurs, thereby lowering the compression efficiency. Moreover, an inaccurate formation of the elongated arcuate hole will result in the production of noise during operation of the compressor.

DISCLOSURE OF THE INVENTION

Accordingly, an object of the present invention is to provide a variable capacity wobbling swash plate type compressing apparatus capable of eliminating the aforementioned problems encountered by the conventional compressors.

In accordance with the present invention, a variable capacity wobbling swash plate type compressing apparatus is provided with a housing means, and a cylinder block means arranged in the housing means so as to have a plurality of cylinder bores disposed radially with respect to the axis of the housing means and equidistantly to one another, the cylinder bores communicating with a fluid suction chamber and a fluid discharge chamber formed in the housing means, respectively, via valve elements. The variable capacity wobbling swash plate type compressor according to the present invention is also provided with a plurality of piston means fitted in the respective cylinder bores so as to be reciprocated therein. The variable capacity wobbling swash plate type compressor according to the present invention is further provided with a drive shaft means arranged so as to extend along the central axis of the housing means, and a swash plate means capable of wobbling about an axis perpendicular to a longitudinal axis of the drive shaft means, shoe means arranged between said swash plate means and said pistons means for converting a rotation of the swash plate means into a reciprocation of the plurality of piston means; the shoe means being also arranged substantially in alignment with the central axis of each of the respective piston means, a rotary drive means fixedly mounted on the drive shaft means, and a connecting means arranged between the rotary drive means and the swash plate means for transmitting a rotation of the rotary drive means to the swash plate means; the connecting means permitting the swash plate means to wobble because of a pressure differential between the fluid suction and/or a discharge chamber and the crank chamber to thereby vary the compression capacity of the piston means.

With the variable capacity wobbling swash plate type compressor according to the present invention, the connecting means is rotatably supported by the rotary drive means, and includes: a bearing element constantly disposed on a line extending from the central axis of each of the piston means; and a connecting pin element extended from the swash plate means and slidable engaged in the bearing element.

In accordance with the present invention, an offset angle from the perpendicularity of the axis of the connecting pin element to the swash plate means is preferably set so that the top clearance of the piston means during the minimum compression capacity operation and the maximum compression capacity operation are equal to one another.

BRIEF DESCRIPTION OF THE DRAWINGS

The above and other objects, features, and advantages of the present invention will be made more apparent from the ensuing description of the preferred embodiments thereof in conjunction with the accompanying drawings wherein.

BEST MODE OF CARRYING OUT THE INVENTION

Figure 1:
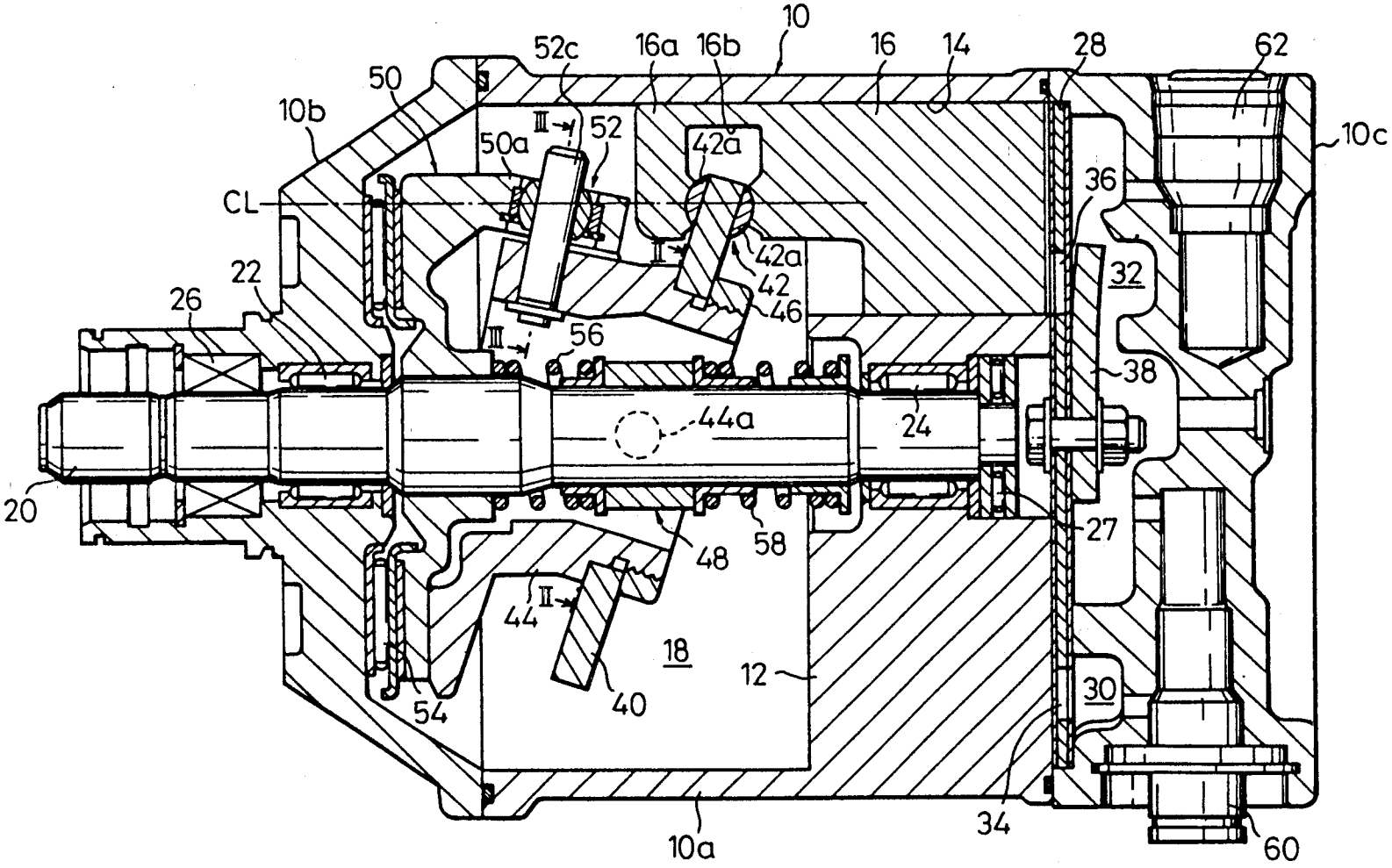
FIG. 1 is a longitudinal cross-sectional view of a variable capacity wobbling swash plate type compressor according to a first embodiment of the present invention.
Figure 2:
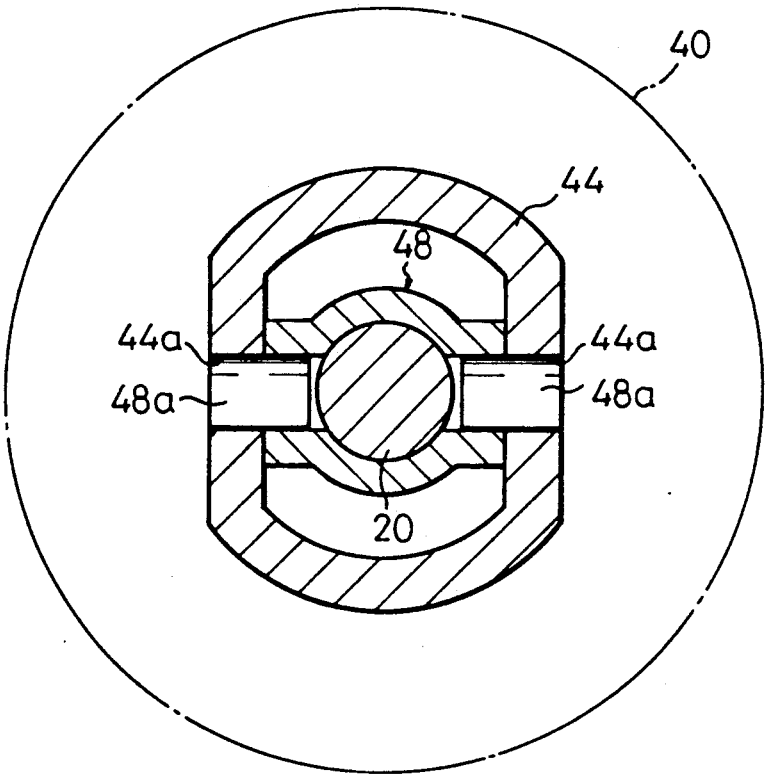
FIG. 2 is a cross sectional view taken along the line II—II of FIG. 1.
Figure 3:
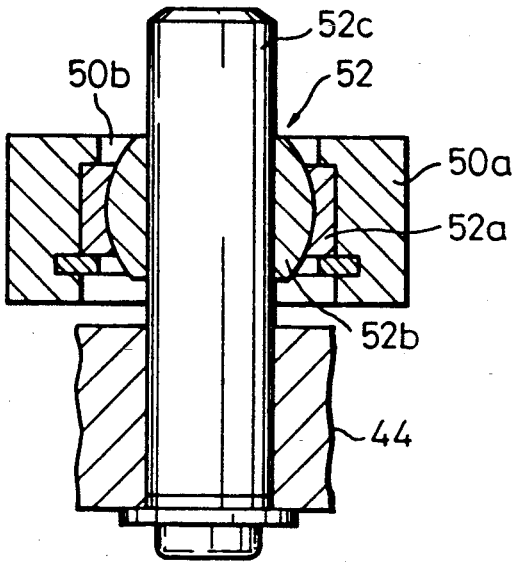
FIG. 3 is a cross sectional view taken along the line III—III of FIG. 1.

Referring to FIGS. 1 through 3, a variable capacity wobbling swash plate type compressor according to the first embodiment of the present invention is provided with a housing generally designated by the reference numeral 10, including a central cylindrical housing 10*a*, a front housing 10*b* fixedly connected to one of the ends of the central housing 10*a*, and a rear housing 106 fixedly connected to the other end of the central housing 10*a*.

The central housing 10*a* is provided with a cylinder block 12 formed as one part, and the cylinder block 12 has a plurality of cylinder bores 14 formed therein. The cylinder bores 14 are arranged radially with respect to the axis of the cylinder block 12, and are circumferentially equidistant to one another. Each cylinder bore 12 slidably receives a piston 16 therein.

A crank chamber 18 is formed between the central housing 10*a* and the front housing 10*b* so as to permit a drive shaft 20 to axially extend along the central axis of the crank chamber 18. A front part of the drive shaft 20 is rotatably supported by a radial bearing 22 housed in the central bore of the front housing 10*b*, and the opposite part of the drive shaft 20 is rotatably supported by a radial bearing 24 housed in the central bore of the cylinder block 12.

As shown in FIG. 1, one end of the drive shaft 20 extends outwardly beyond the end of the front housing 10*b* so as to be operatively connected to an automobile engine thereby obtaining a rotary drive power. In FIG. 1, reference numeral 26 designates a shaft seal for sealing the crank chamber 18 from outside the compressor, and reference numeral 27 designates a thrust bearing for supporting the end of the drive shaft 20.

A valve plate assembly 28 is arranged between the central housing 10*a* and the rear housing 10*c*, and suction and discharge chambers 30 and 32 are arranged between the valve assembly 28 and the rear housing 10*c*. The suction and discharge chambers 30 and 32 are communicated with a condenser and an evaporator of an air-conditioning system of, e.g., an automobile, respectively. Namely, the suction chamber 30 is supplied with refrigerant gas from the condenser, and the discharge chamber 32 supplies the refrigerant gas after compression to the evaporator.

The valve assembly 28 is provided with suction ports 34 formed therein, the number of which corresponds to that of the cylinder bores 14, and each of the suction ports 34 is closed by a reed valve accommodated in the valve assembly 28. The valve assembly 28 is also provided with discharge ports 36 formed therein; the number of which corresponds to that of the cylinder bores 14, and each of the discharge ports 36 is closed by a reed valve accommodated in the valve assembly. Reference numeral 38 in FIG. 1 designates a valve retainer restricting the extent of opening of the reed valves closing the discharge ports 36.

A swash plate 40 is slidably engaged with pistons 16 via shoe means 42 to thereby reciprocate respective pistons 16 in the associated cylinder bores 14. More specifically, each piston 16 is provided with an extension 16*a* formed so as to extend beyond the end of the corresponding cylinder bore 14. The extension 16*a* of each piston 16 is provided with a cavity portion 16*c* formed therein. The shoe means 42 includes a pair of semi-spherical shoe elements 42*a*, 42*a* that are slidably received in a spherically recessed portion formed at the entrance of the cavity portion 16*c* of the piston 16. The pair of semi-spherical shoe elements 42*a* and 42*a* are slidably engaged with an outermost periphery of the swash plate 40 positioned between these shoe elements. Therefore, when the swash plate 40 is rotated together with the drive shaft 20 about the axis of the drive shaft 20, each piston 16 is reciprocated in the associated cylinder bore 14.

In the first embodiment of the present invention as shown in FIG. 1, a pair of shoe elements 42*a*, 42*a* are accommodated in the extension of the piston 16 in such a manner that both shoe elements are located on the center line CL of the piston 16. Thus, when the swash plate 40 is rotated, i.e., when the piston 16 is reciprocated, the pair of shoe elements 42*a*, 42*a* are pivoted about respective centers located on the center line CL of the piston 16. Namely, respective shoe means 42 are always prevented from radial displacement with respect to the associated pistons 16, however, the respective shoe means 42 permits the swash plate 40 to radially shift relative to the shoe means 42. Thus, the rotation of the swash plate 40 is smoothly converted into a reciprocation of the respective pistons 16.

The swash plate 40 is fixed to a substantially cylindrical, rotatable wobbling member 44 by a ring-like clamping element 46, and the rotatable wobbling member 44 is pivoted about an axis perpendicular to the axis of the drive shaft 20 so as to be able to perform a wobbling movement about the pivoting axis. Namely, as best shown in FIG. 2, on the drive shaft 20 is slidably mounted a sleeve element 48 provided with a pair of laterally extending trunnion pins 48*a*, 48*a* slidably received in bearing bores 44*a* of the rotatable, wobbling member 44.

The rotatable wobbling member 44 is rotated by a rotary drive plate 50 fixedly mounted on the drive shaft 20, i.e., the rotary drive plate 50 transmits the rotation of the drive shaft 20 to the rotatable wobbling member 44. More specifically, the rotary drive plate 50 is provided with an extension 50*a* having an opening 50*b* formed therein as best shown in FIG. 3. A connecting means 52 is provided in the opening 50*b* so as to be disposed substantially in alignment with the center line CL of each of the pistons 16. The connecting means 52 includes a race element 52*a* fixedly seated in the opening 50*b*, a spherical bearing element 52*b* slidably held in a spherical receiving surface formed in the race element 52*a*, and a connecting pin element 52*c* slidably inserted in a through-hole of the spherical bearing element 52*b*, and one end of the connecting pin element 52*c* is inserted into and fixed to the rotatable wobbling member 44. Thus, when the drive shaft 20 is rotated, the rotatable wobbling member 44 is rotated together with the drive shaft 20. In FIG. 1, reference numeral 54 denotes a thrust bearing for axially supporting the rotary drive plate 50, and reference numerals 56 and 58 denote coil springs, respectively, mounted on the drive shaft 20 so as to restrict a sliding movement of the sleeve element 48 on the drive shaft 20.

When the rotatable wobbling member 44 is rotated, and therefore when the swash plate 40 is rotated, the respective pistons 16 are reciprocated in the associated cylinder bores 14 as previously stated.

During the suction stroke of each piston 16, the refrigerant gas flows in the cylinder bore 14 from the suction chamber 30 via the suction port 34. Subsequently, during the compression stroke of the piston 16, the refrigerant gas is gradually compressed in the cylinder bore 14 and the compressed refrigerant gas is discharged from the cylinder bore 14 toward the discharge chamber 32 via the discharge port 36.

Similarly to the conventional variable capacity wobble plate type compressor, the crank chamber 18 communicates with the suction chamber 30 and the discharge chamber 32, respectively, via fluid lines in which solenoid valves 60 and 62 are arranged. The solenoid valves 60 and 62 are operated so as to adjust the pressure level of the refrigerant gas prevailing in the crank chamber 18 thereby adjustably changing the angle of inclination of the swash plate 40. Consequently, the stroke of the respective pistons 16 is expanded or shortened so as to vary the compression capacity. At this stage, it should be noted that when the angle of inclination of the swash plate 40 is changed, the wobbling movement of the swash plate 40 is caused by the assistance of the pivoting of the spherical bearing element 52*b*, the sliding movement of the connecting pin element 52*c* with respect to the spherical bearing element 52*b*, and the sliding movement of the sleeve element 48 on the drive shaft 20. Further, the center of the spherical bearing element 52*b* is able to function as a fulcrum about which the rotatable wobbling member 44 wobbles. In the other words, the locations of the pair of semi-spherical shoe elements 42*a*, 42*a* and the spherical bearing element 52*b* are substantially and constantly kept stationary from the center line CL of the respective pistons 16 regardless of the angle of inclination of the swash plate 40. Thus, during the compression stroke of the respective pistons 16, a reaction force acting on the swash plate 40 via the pistons 16 due to the compression of the refrigerant gas does not produce a rotary moment acting on the rotatable wobbling member 44 about the center of the spherical bearing element 52*b*, and accordingly a smooth adjustment of the angle of inclination of the swash plate 40 and accurate control of the compression capacity can be attained.

Figure 4:
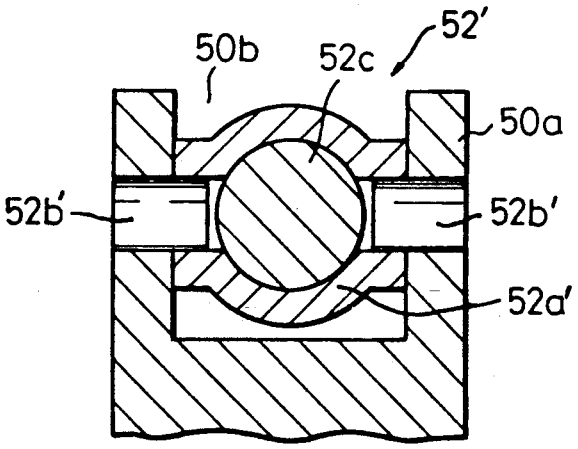
FIG. 4 is a cross sectional view similar to FIG. 3, illustrating a variation of the embodiment of FIG. 1.

Referring to FIG. 4 illustrating a variation of the afore-described first embodiment, a connecting means 52' includes a sleeve element 52*a'* slidably receiving the connecting pin element 52*c*, and a pair of trunnion pin elements 52*b'* extending from the opposite sides of the sleeve element 52*a'* and rotatably supported by the extension 50*a* of the rotary drive plate 50. In accordance with the above-mentioned construction, during the compression stroke of the respective pistons 16, the reaction force due to compression of the refrigerant gas in the cylinder bores 14 acts on the swash plate 40, but does not produce a rotary moment acting on the rotatable wobbling member 44.

Figure 5:
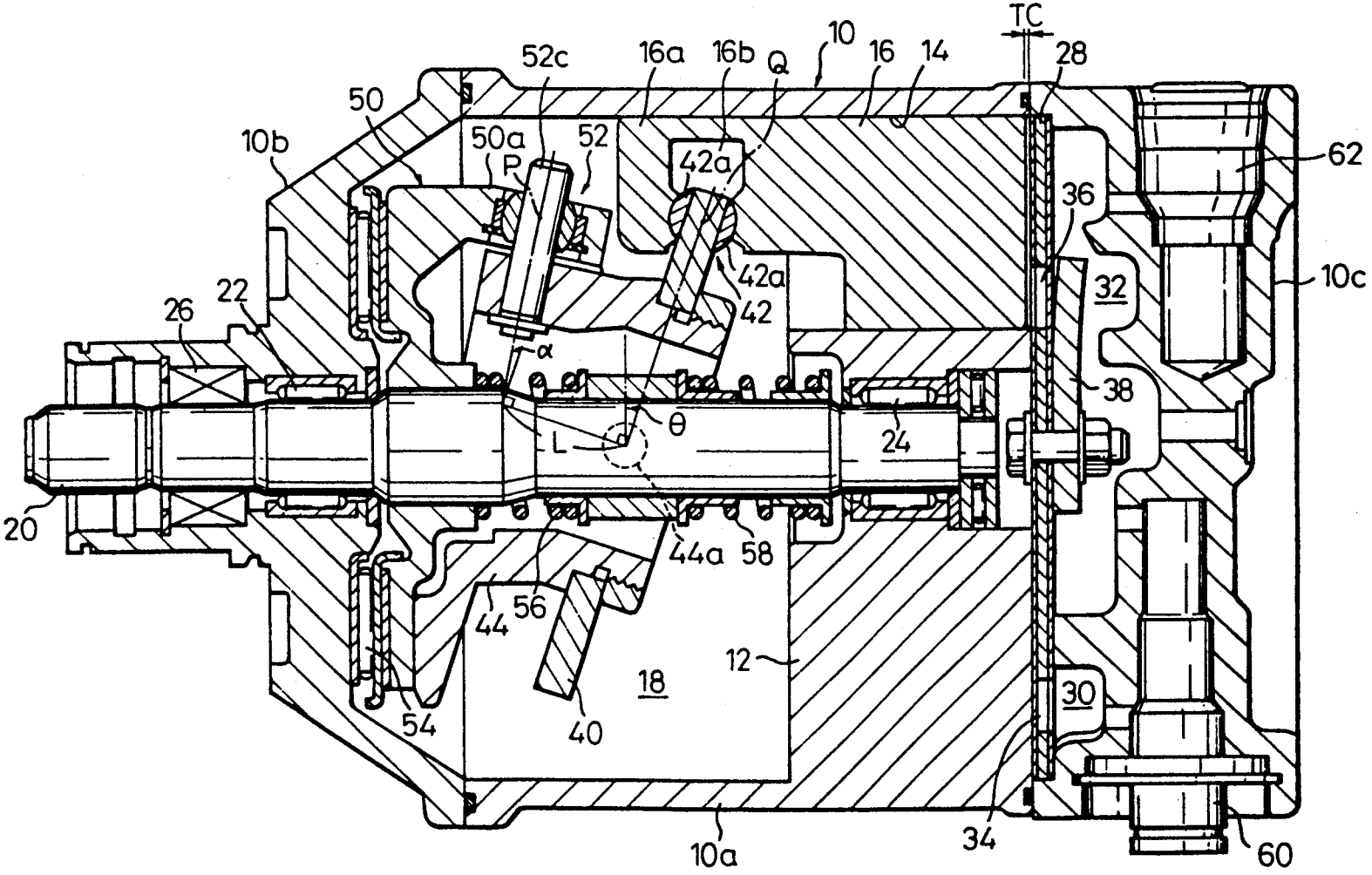
FIG. 5 is a longitudinal cross-sectional view of a variable capacity wobbling swash plate type compressor according to a second embodiment of the present invention.

Referring to FIG. 5, a variable capacity wobble plate type compressor according to the second embodiment of the present invention is shown. The arrangement and construction of the second embodiment is substantially similar to the afore-mentioned first embodiment. Nevertheless, in the second embodiment, a construction is adopted such that a change in the clearance between the piston head of each piston 16 and the valve plate assembly when the piston 16 is at the top dead center thereof, i.e., a change in the top clearance TC is made the smallest, and thus, a reduction in compression efficiency as well as the production of noise is prevented. Namely, in the second embodiment, an offset angle $\alpha$ defined as an angular differential of the central axis of the connecting pin element 52c from a plane parallel to the swash plate 40 is set so that an amount of the top clearance TC becomes optimum when the swash plate 40 is at the maximum and the minimum inclination angle positions $\theta_{max}$ and $\theta_{min}$. Therefore, when the angle $\theta$ of inclination of the swash plate 40 varies between the maximum and the minimum inclination angle positions $\theta_{max}$ and $\theta_{min}$, a variation of the top clearance TC is made the smallest as further described later.

Figure 6:
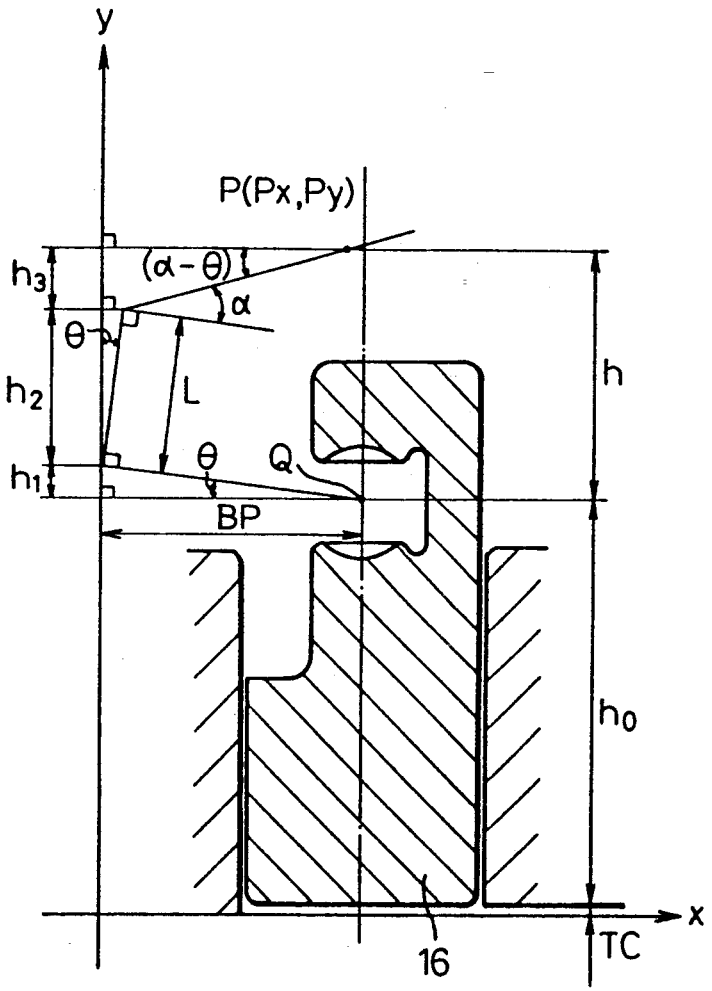
FIG. 6 is an explanatory view, illustrating the feature of the second embodiment of FIG. 5.

As shown in FIG. 6, it is assumed that an x- and y-coordinate system having an x-axis extending along the end face of the cylinder block 12, and an y-axis extending along the central axis of the drive shaft 20 is set to lie in a cross sectional plane of the piston 16, and the coordinate values of the center of the spherical bearing element 52b, i.e., the fulcrum p of the connecting pin element 52c is expressed as $P_x$, $P_y$, and the value of the y-coordinate of the point Q on which a reaction force due to compression of the refrigerant gas acts on the swash plate 40 is expressed as $h_0$. Further, the distance between the above-mentioned point Q and the central axis of the drive shaft 20, i.e., the y-axis along a line perpendicularly extending from the point Q to the y-axis is expressed as BP, and the distance between the wobbling center of the rotatable wobbling member 44 and the central axis of the connecting pin element 52c taken along a line perpendicularly extending from the wobbling center to the face of the swash plate 40 is expressed as L. The top clearance TC can then be defined by an equation, below.

$$TC=P_y-h-h_0 \quad (1)$$

From the illustration of FIG. 6, "h" can be expressed by an equation, below.

$$h=h_1+h_2+h_3 \quad (2)$$

From the illustration of FIG. 6, it will be understood that $h_1$, $h_2$, and $h_3$ can be expressed by equations set forth below.

$$h_1=BP\tan\theta \quad (3\text{-}1)$$

$$h_2=L\cos\theta \quad (3\text{-}2)$$

$$h_3=(P_x-L\sin\theta)\tan(\alpha-\theta) \quad (3\text{-}3)$$

Therefore, when the equations (2), (3-1), (3-2), and (3-3) are substituted into the equation (1), an equation (4), below is established.

$$TC=P_y-h_0-[BP\tan\theta+L\cos\theta+(P_x-L\sin\theta)\tan(\alpha-\theta)] \quad (4)$$

Since $\tan(\alpha-\theta)=(\tan\alpha-\tan\theta)/(1+\tan\alpha\cdot\tan\theta)$, the equation (4) can be rewritten in an equation set forth below.

$$(P_y-h_0-BP\tan\theta-TC)(1+\tan\alpha\cdot\tan\theta)=L\cos\theta(1+\tan\alpha\cdot\tan\theta)+(P_x-L\sin\theta)(\tan\alpha-\tan\theta)=L\cos\theta+L\sin\theta\cdot\tan\alpha+P_x\tan\alpha-P_x\tan\theta-L\sin\theta\cdot\tan\alpha+L\sin\theta\cdot\tan\theta$$

Thus, $$P_y-h_0-BP\tan\theta-TC+P_x\tan\theta=[P_x-(P_y-h_0-BP\tan\theta-TC)\tan\theta]\tan\alpha+L/\cos\theta$$

Further, an equation below is obtained.

$$(P_y-h_0-BP\tan\theta-TC+P_x\tan\theta)\cos\theta=[P_x\cos\theta-(P_y-h_0-BP\tan\theta-TC)\sin\theta]\cdot\tan\alpha+L \quad (5)$$

At this stage, to make a variation of the top clearance TC of the respective pistons in response to a change in the angle of inclination of the swash plate from the maximum inclination position $\theta_{max}$ to the minimum inclination position $\theta_{min}$, such conditions as set forth below must be satisfied.

$$\text{When } \theta=\theta_{max},\ TC=0 \quad (6\text{-}1)$$

$$\text{Also, when } \theta=\theta_{min},\ TC=0 \quad (6\text{-}2)$$

Therefore, when the conditions (6-1), and (6-2) are substituted into the above equation (5), equations set forth below are obtained.

$$a_1=a_2\tan\alpha+L \quad (7\text{-}1)$$

$$b_1=b_2\tan\alpha+L \quad (7\text{-}2)$$

where $$a_1=(P_y-h_0-BP\tan\theta_{max}+P_x\tan\theta_{max})\cdot\cos\theta_{max} \quad (8\text{-}1)$$

$$a_2=(P_x\cos\theta_{max}-(P_y-h_0-BP\tan\theta_{max})\cdot\sin\theta_{max} \quad (8\text{-}2)$$

$$b_1-(P_y-h_0-BP\tan\theta_{min}+P_x\tan\theta_{min})\cdot\cos\theta_{min} \quad (8\text{-}3)$$

and, $$b_2=P_x\cos\theta_{min}-(P_y-h_0-BP\tan\theta_{min})\cdot\sin\theta_{min} \quad (8\text{-}4)$$

Accordingly, $$\alpha=\tan^{-1}[(a_1-b_1)/(a_2-b_2)] \quad (9\text{-}1)$$

and, $$L=(a_2b_1-a_1b_2)/(a_2-b_2)] \quad (9\text{-}2)$$

are obtained.

Namely, in the variable capacity wobbling swash plate type compressor of FIG. 5, the position of the fulcrum P ($P_x$, $P_y$), the coordinate $h_0$ of the position Q where the reaction force due to compression of the refrigerant acts on the swash plate, the maximum inclination angle position $\theta_{max}$, the minimum inclination angle position $\theta_{min}$, and the distance BP are determined, the optimum offset angle $\alpha$, and the distance L can be set on the basis of the equations (9-1) and (9-2).

Thus, it is possible to determine an optimum top clearance TC at both the maximum and minimum inclination angle positions of the swash plate.

Figure 7:
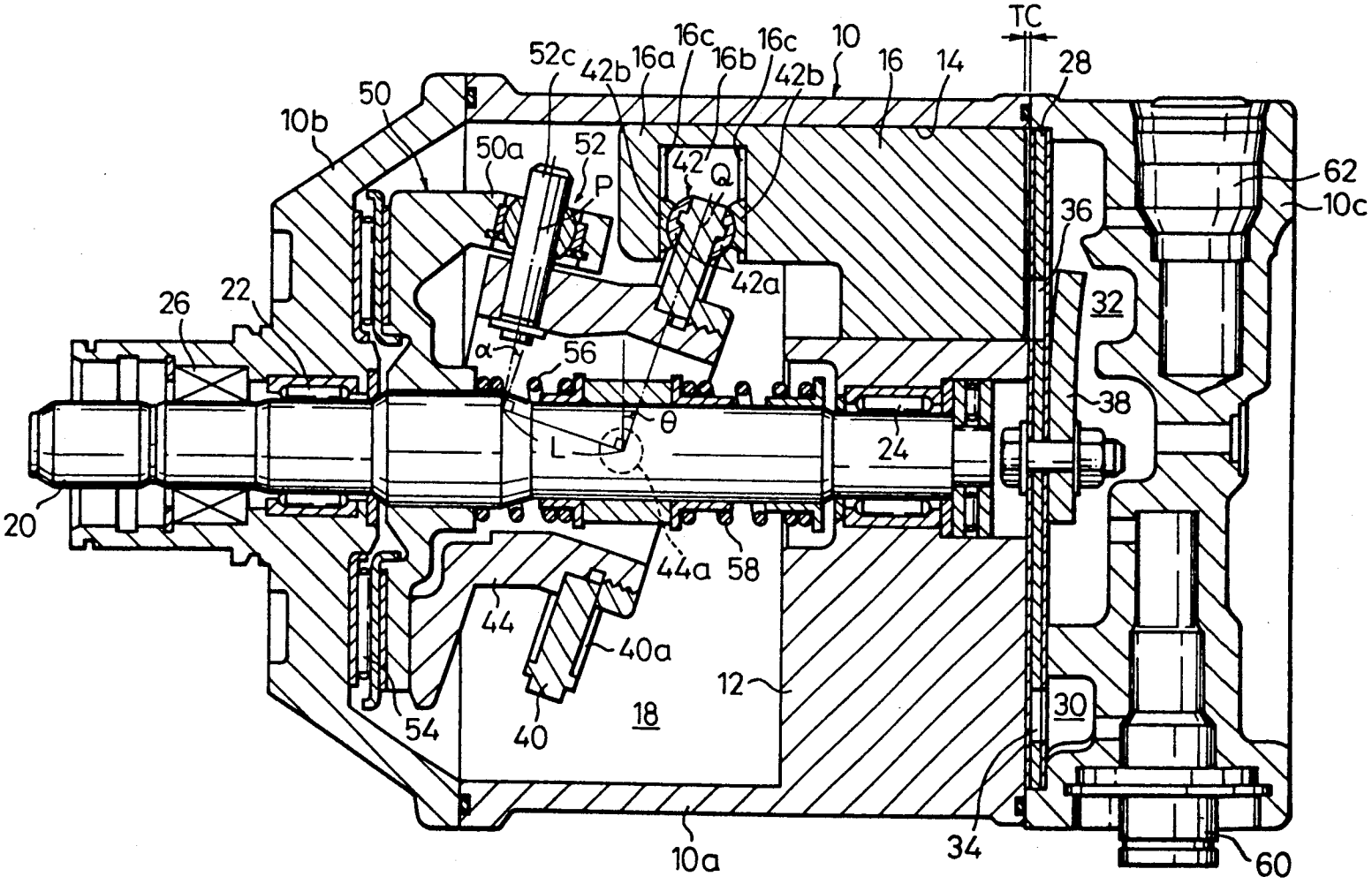
FIG. 7 is a longitudinal cross-sectional view of a variable capacity wobbling swash plate type compressor according to a third embodiment of the present invention.

FIG. 7 illustrates a variable capacity wobbling swash plate type compressor according to the third embodiment of the present invention.

In accordance with the third embodiment, a swash plate 40 is provided with annular keys 40*a*, 40*a* on opposite sides thereof, and a shoe means 42 includes a pair of inner shoe elements 42*a*, 42*a* and a pair of outer shoe elements 42*b*, 42*b*. Each inner shoe element is provided with an inner flat face having a key groove slidably engaged with the corresponding annular key 40*a*, and an outer spherical convex surface slidably engaged with an inner concaved spherical surface of the corresponding outer shoe element 42*b*. The outer spherical convex surfaces of the shoe elements 42*b*, 42*b* are slidably engaged with cylindrical surfaces 16*c* formed in the cavity portion 16*b* of the extension 16*a* of each piston. That is, when the swash plate 40 is rotated, i.e., the pistons 16 are reciprocated, the respective shoe means 42 is permitted to displace in a radial direction with respect to the respective pistons 16. Nevertheless, the swash plate 40 is prevented from radially moving with respect to the respective shoe means 42 and hence, rotation of the swash plate 40 is smoothly converted into a reciprocation of the respective pistons 16. Although the respective shoe means 42 is permitted to displace radially with respect to the pistons 16, the amount of displacement is extremely small. Therefore, it is possible to say that the shoe means 42 and the connecting pin means 52 are constantly arranged in substantial alignment with the central axis of respective pistons 16. Thus, when the respective pistons 16 are at the compression stroke thereof, the reaction force owing to compression acting on the swash plate 40 via respective pistons can always be prevented from producing a rotary moment acting on the rotary wobbling member 44 about the center of the spherical bearing elements 52*b*.

In accordance with the third embodiment, an offset angle $\alpha$ of the connecting pin element 52*c* of the connecting pin means 52 relative to the swash plate 40 can be set in such a manner that the top clearance TC becomes optimum when the angle $\theta$ of inclination of the swash plate 40 attains maximum and minimum values $\theta_{max}$ and $\theta_{min}$. This is explained hereinbelow.

Figure 8:
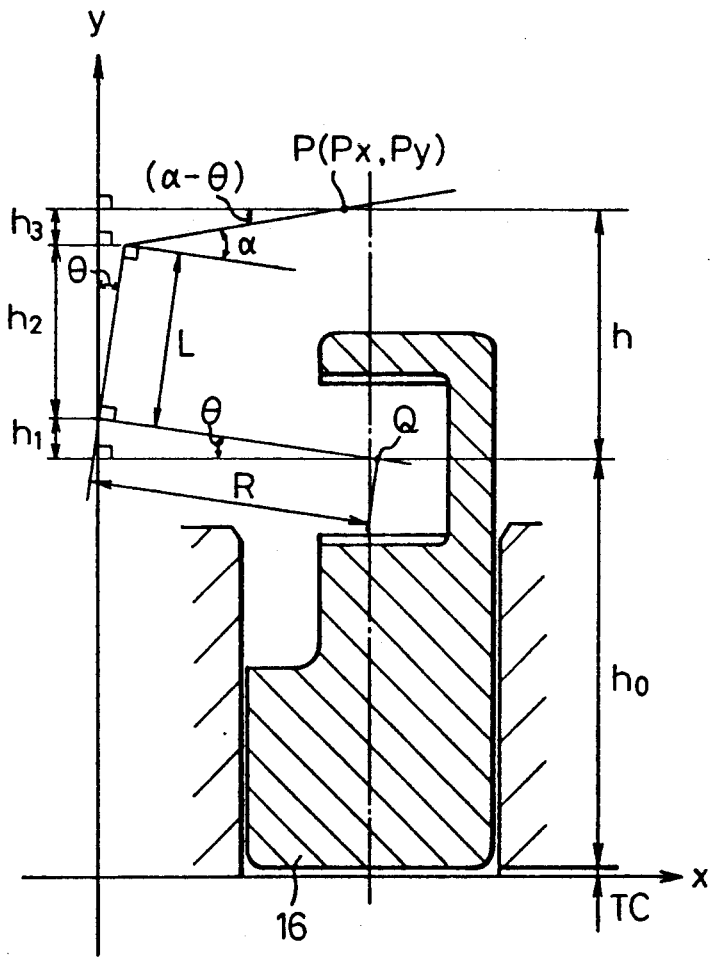
FIG. 8 is an explanatory view, illustrating a feature of the third embodiment of FIG. 7.

In FIG. 8 similar to FIG. 6, an X- and Y-coordinate system lying in a cross section of the piston 16 and including an x-axis extending along the end face of the cylinder block 12 and y-axis extending along the central axis of the drive shaft 20 is set.

The coordinate of the center of the spherical bearing element 52*b*, i.e., the fulcrum P of the connecting pin element 52*c* is then expressed as $P_x$ and $P_y$ in the X- and Y- coordinate system, and the Y-coordinate of the acting point Q where the reaction force owing to compression of the refrigerant gas acts on the swash plate 40 via the respective pistons 16 can be expressed as $h_0$.

Further, the distance between the wobbling center of the rotary wobbling member 44 and the acting point Q of the reaction force is expressed as R, and the distance between the wobbling center of the rotary wobbling member 44 and the center axis of the connecting pin element 52*c* along a line extending perpendicular from the above-mentioned wobbling center of the rotary wobbling member to the face of the swash plate is expressed as L.

The top clearance TC is then expressed by an equation set forth below.

$$TC=P_y-h-h_0 \tag{10}$$

At that time, it is obvious from the illustration of FIG. 8 that h can be expressed by an equation set forth below.

$$h=h_1+h_2+h_0 \tag{11}$$

Further, as clearly shown in FIG. 8, $h_1$, $h_2$, and $h_3$ are expressed by equations set forth below, respectively.

$$h_1=R\sin\theta \tag{12-1}$$

$$h_2=L\cos\theta \tag{12-2}$$

$$h_3=(P_x-L\sin\theta)\cdot\tan(\alpha-\theta) \tag{12-3}$$

Therefore, when these equations (11), (12-1), (12-2), and (12-3) are substituted into the equation (10), an equation set forth below can be obtained.

$$TC=P_y-h_0[(R\sin\theta+L\cos\theta+(P_x-L\sin\theta)\cdot\tan(\alpha-\theta)] \tag{13}$$

It should here be noted that since an equation, i.e., $$\tan(\alpha-\theta)=(\tan\alpha-\tan\theta)/(1+\tan\alpha\cdot\tan\theta)$$

can be established, the above equation (13) can be reformed as follows.

$$(P_y-h_0-R\sin\theta-TC)(1+\tan\alpha\cdot\tan\theta)=L\cos\theta+L\sin\theta\cdot\tan\alpha+P_x\tan\alpha-L\sin\theta\cdot\tan\alpha-P_x\tan\theta\,L\sin\theta\cdot\tan\theta$$

Therefore, $$P_y-h_0-R\sin\theta-TC+P_x\tan\theta=[-P_x-(P_y-h_0-R\sin\theta-TC)\cdot\tan\theta]\cdot\tan\alpha+L/\cos\theta$$

Also, $$(P_y-h_0-R\sin\theta-TC+P_x\tan\theta)\cos\theta=[P_x\cos\theta-(P_y-h_0-R\sin\theta-TC)\cdot\sin\theta]\cdot\tan\theta+L \tag{14}$$

At this stage, to minimize the variation of the top clearance TC when the angle $\theta$ of inclination of the swash plate is changed from the maximum inclination angle position $\theta_{max}$ to the minimum inclination angle position $\theta_{min}$, the following equations should be satisfied.

$$\text{when } \theta=\theta_{max},\ TC=0 \tag{15-1}$$

$$\text{when } \theta=\theta_{min},\ TC=0 \tag{15-2}$$

Accordingly, when the equations (15-1) and (15-2) are substituted into the equation (14), the equations set forth below are obtained.

$$a_1=a_2\tan\alpha+L \tag{16-1}$$

$$b_1=b_2\tan\alpha+L \tag{16-2}$$

However, further equations set forth below are established.

$$a_1=(P_y-h_0-R\sin\theta_{max}+P_x\tan\theta_{max})\cos\theta_{max} \tag{17-1}$$

$$a_2=P_x\cos\theta_{max}-(P_y-h_0-R\sin\theta_{max})\sin\theta_{max} \tag{17-2}$$

$$b_1=(P_y-h_0-R\sin\theta_{min}+P_x\tan\theta_{min})\cdot\cos\theta_{min} \quad (17\text{-}3)$$

$$b_2=(P_x\cos\theta_{min}-(P_y-h_0-R\sin\theta_{min})\sin\theta_{min} \quad (17\text{-}4)$$

Accordingly, the following equations are obtained.

$$\alpha=\tan^{-}[(a_1-b_1)/(a_2-b_2)] \quad (18\text{-}1)$$

$$L=(a_2b_1-a_1b_2)/(a_2-b_2) \quad (18\text{-}2)$$

When the fulcrum position P ($P_x$, $P_y$), the position $h_0$ of the reaction force acting position Q, the maximum inclination angle position $\theta_{max}$ of the swash plate, the minimum inclination angle position $\theta_{min}$ of the swash plate, and the radius R are determined in the same manner as the afore-mentioned second embodiment, on the basis of the above equations (17-1), (17-2), (17-3) and (17-4), the optimum offset angle $\alpha$ and the optimum distance L can be set by the above equations (18-1) and (18-2). Thus, the top clearance TC at the smallest compression capacity and at the largest compression capacity can be made optimum.

Figure 9:
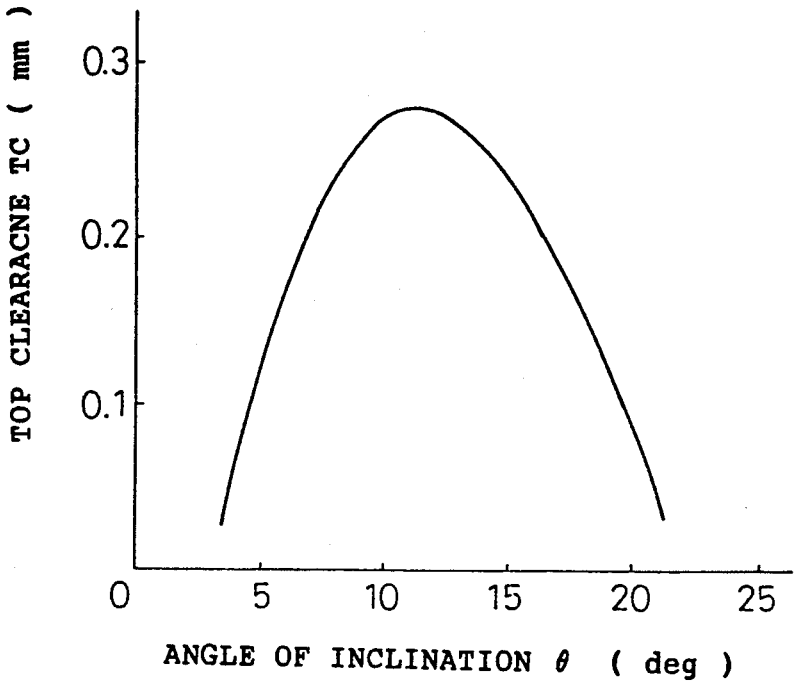
FIG. 9 is a graphical view indicating a relationship between the top clearance of the piston of the third embodiment; and, FIG. 10 is a graphical view comparatively indicating a change in the top clearance of the piston set in accordance with the prior art and in the top clearance of the piston set in accordance with the present invention.

For example, when $P_x=33$ mm, $P_y=87$ mm, $h_0=54$ mm, $\theta_{max}=22$ degrees, $\theta_{min}=3.133$ degrees, and R=36 mm, then $\alpha=16.33$ degrees, and L=23.63 mm can be obtained, and the relationship between the angle $\theta$ (degrees) of inclination of the swash plate and the top clearance TC (mm) of each piston is shown in FIG. 9.

For comparison's sake, the relationship between the angle of inclination (deg.) and the top clearance TC (mm) when the offset angle $\alpha$ does not satisfy the above-mentioned conditions is shown.

Figure 10:
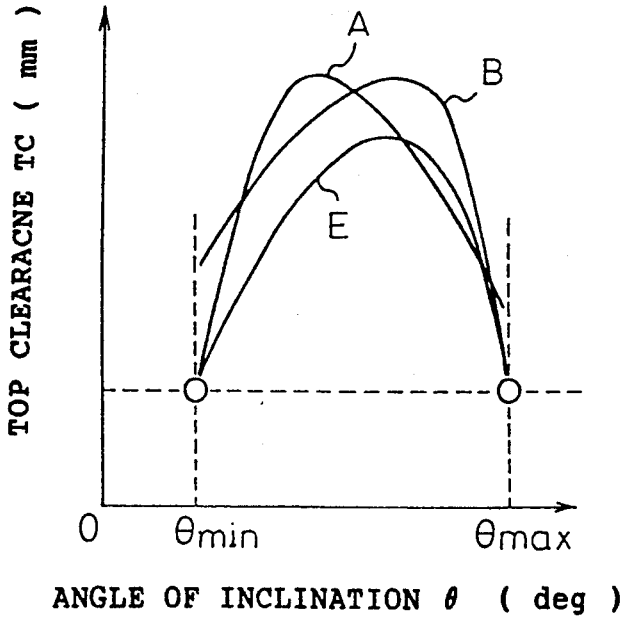

As shown by the curve "A" in FIG. 10, if the offset angle $\alpha$ is set in such a manner that the top clearance TC is made optimum when compression capacity is smallest, the top clearance TC at the maximum compression capacity is greatly increased compared with the top clearance TC at the smallest compression capacity. Further, as shown by the curve "B" in FIG. 10, if the top clearance TC is set to become optimum at the largest compression capacity, the top clearance TC at the smallest compression capacity is greatly increased compared with the optimum value of the top clearance TC.

The curve "E" of FIG. 10 is similar to the curve shown in FIG. 9, and thus, the top clearance TC is made optimum at both the largest and smallest compression capacities.

Further, as is obvious from the illustration of FIG. 10, the largest top clearance TC in the case of the curve E with respect to a change in the compression capacity from the smallest to largest is smaller than in the case of the curves "A" and "B". Therefore, a variation in the top clearance TC can only be within approximately 0.285 mm. Namely, when a variation in the top clearance TC in response to a change in the compression capacity is made small, an increase in compression efficiency can be obtained.

We claim:

1. A variable capacity wobbling swash plate type compressing apparatus comprising:

a housing means having a central longitudinal axis thereof;

a cylinder block means arranged in the housing means; said cylinder block means being provided with cylinder bores arranged radially equidistantly spaced at a predetermined distance from and equidistantly spaced circumferentially about said central axis of the housing means; said cylinder bores being in communication with a fluid suction chamber and a fluid discharge chamber, respectively, via valve elements;

individual piston means arranged in each of said cylinder bores, each of said piston means having a central longitudinal axis and being slidable within said respective cylinder bores along said piston axis;

a drive shaft means having a longitudinal axis and extending along said central axis of the housing means in a crank chamber defined by said housing means;

a swash plate means capable of wobbling about an axis perpendicular to said longitudinal axis of the drive shaft means;

shoe means arranged between said swash plate means and said respective piston means for converting rotation of said swash plate means into reciprocation of said respective pistons; said shoe means being arranged in substantial alignment with said central longitudinal axes of said respective piston means;

a rotary drive means fixedly mounted on said drive shaft means; and connecting means arranged between said rotary drive means and said swash plate means for transmitting rotation of said rotary drive means to said swash plate means; said connecting means permitting wobbling movement of said swash plate means in response to a pressure differential between said fluid suction and/or discharge chambers and said crank chamber to thereby vary the compression capacity of said piston means, said connecting means comprising:

a pivotable bearing element having a through hole therein and being supported by said rotary drive means for rotation therewith and arranged at said predetermined radial distance from said central axis of the housing for traversing a circular path upon said rotation which path intercepts the longitudinal extensions of said central longitudinal axes of said piston means; and a connecting pin element radially extending from said swash plate means and slidably engaged within said through hole of said pivotable bearing element.

2. A variable capacity wobbling swash plate type compressing apparatus according to claim 1, wherein said connecting pin element is arranged to have an offset angle with respect to said swash plate means such that top clearances of each of said piston means are unchanged during the maximum and minimum compression capacity operations of said piston means.

3. A variable capacity wobbling swash plate type compressing apparatus according to claim 1, wherein said pivotable bearing element comprises a spherical bearing element rotatably seated in a race element fixedly held by said rotary drive means, said spherical bearing element having a center thereof located at said predetermined radial distance from said central axis of the housing.

4. A variable capacity wobbling swash plate type compressing apparatus comprising:

a housing means having a central axis thereof;

a cylinder block means arranged in the housing means; said cylinder block means being provided with cylinder bores arranged radially with respect to the central axis of the housing means and equidistantly to one another; said cylinder bores being in communication with a fluid suction chamber and a fluid discharge chamber, respectively, via valve elements;

piston means arranged in said cylinder bores, each of the piston means being slidable within said respective cylinder bores and having a central axis thereof;

a drive shaft means extending along the central axis of the housing means in a crank chamber defined by said housing means;

a swash plate means capable of wobbling about an axis perpendicular to a longitudinal axis of the drive shaft means;

shoe means arranged between said swash plate means and said respective piston means for converting a rotation of said swash plate means into reciprocation of said respective pistons; said shoe means being arranged in substantial alignment with the central axes of said respective piston means;

a rotary drive means fixedly mounted on said drive shaft means; and a connecting means arranged between said rotary drive means and said swash plate means for transmitting a rotation of said rotary drive means to said swash plate means; and connecting means permitting a wobbling movement of said swash plate means in response to a pressure differential between said fluid suction and/or discharge chambers and said crank chamber to thereby vary the compression capacity of said piston means, said connecting means comprising:

a bearing element rotatably supported by said rotary drive means and arranged on a line extending from the central axis of each of said piston means; and a connecting pin element extending from said swash plate means and slidably engaged within said bearing element;

said connecting pin element being arranged to have an offset angle with respect to said swash plate means such that top clearances of each of said piston means are unchanged during the maximum and minimum compression capacity operations of said piston means; and said shoe means being arranged in such a manner that said swash plate means is permitted to perform a relative radial displacement with respect to said shoe means, but that said shoe means is prevented from performing a relative radial displacement with respect to said piston means, and wherein when said offset angle is expressed by "α[, the angle "α" is determined by the equations set forth below:

$$\alpha = tan^{-1}[(a_1 - b_1)/(a_2 - b_2)],$$

$$L = (a_2 b_1 - a_1 b_2)/(a_2 - b_2),$$

$$a_1 = (P_y - h_o - BP \tan \theta_{max} + P_x \tan \theta_{max}) \cdot \cos \theta_{max},$$

$$a_2 = (P_x \cos \theta_{max} - (P_y - h_o - BP \tan \theta_{max}) \cdot \sin \theta_{max},$$

$$b_1 = (P_y - h_o - BP \tan \theta_{min} + P_x \tan \theta_{min}) \cdot \cos \theta_{min},$$

and $$b_2 = P_x \cos \theta_{min} - (P_y - h_o - BP \tan \theta_{min}) \cdot \sin \theta_{min},$$

where $P_x$ and $P_y$ indicates an x-ordinate and y-ordinate of a fulcrum of said connecting pin element, respectively when the X- and Y- ordinate system is set to lie in a cross sectional plane and has an x-axis extending along an end face of said cylinder block means and a y-axis extending along the center axis of said drive shaft means; $h_o$ indicates a y-ordinate of an acting point with a reaction force of the compression operation of said piston means; BP indicates the perpendicular distance between said acting point and said y-axis of the X- and Y-ordinate system; L indicates the distance between a wobbling center of said swash plate means and a center line of said connecting pin element along a line vertically extending from said wobbling center of said swash plate means and a center line of said connecting pin element along a line vertically extending from said wobbling center of said swash plate to the face of said swash plate means; $\theta_{max}$ indicates the maximum value of an angle of inclination of said swash plate means, and $\theta_{min}$ indicates the minimum value of an angle of inclination of said swash plate means.

5. A variable capacity wobbling swash plate type compressing apparatus comprising:

a housing means having a central axis thereof;

a cylinder block means arranged in the housing means; said cylinder block means being provided with cylinder bores arranged radially with respect to the central axis of the housing mean and equidistantly to one another; said cylinder bores being in communication with a fluid suction chamber and a fluid discharge chamber, respectively, via valve elements;

piston means arranged in said cylinder bores, each of the piston means being slidable within said respective cylinder bores and having a center axis thereof;

a drive shaft means extending along the central axis of the housing means in a crank chamber defined by said housing means;

a swash plate means capable of wobbling about an axis perpendicular to a longitudinal axis of the drive shaft means;

shoe means arranged between said swash plate means and said respective piston means for converting a rotation of said swash plate means into reciprocation of said respective pistons; said shoe means being arranged in substantial alignment with central axes of said respective piston means;

a rotary drive means fixedly mounted on said drive shaft means; and a connecting means arranged between said rotary drive means and said swash plate means for transmitting a rotation of said rotary drive means to said swash plate means; said connecting means permitting a wobbling movement of said swash plate means in response to a pressure differential between said fluid suction and/or discharge chambers and said crank chamber to thereby vary the compression capacity of said piston means, said connecting means comprising:

a bearing element rotatably supported by said rotary drive means and arranged on a line extending from the central axis of each of said piston means; and a connecting pin element extending from said swash plate means and slidably engaged within said bearing element;

said connecting pin element being arranged to have an offset angle with respect to said swash plate means such that top clearances of each of said piston means are unchanged during the maximum and minimum compression capacity operations of said piston means;

said shoe means being arranged in such a manner that said swash plate means is prevented from performing a relative radial displacement with respect to said shoe means, but that said shoe means is permitted to perform a relative radial displacement with respect to said piston means, and wherein when said offset angle is expressed by "$\alpha$", the angle "$\alpha$" is determined by the equations set forth below:

$$\alpha=\tan^{-1}[(a_1-b_1)/(a_2-b_2)],$$

$$L=(a_2b_1-a_1b_2)/(a_2-b_2),$$

$$a_1=(P_y-h_o-R\sin\theta_{max}+P_x\tan\theta_{max})\cos\theta_{max},$$

$$a_2=P_x\cos\theta_{max}-(P_y-h_o-R\sin\theta_{max})\sin\theta_{max},$$

$$b_1=(P_y-h_o-R\sin\theta_{min}+P_x\tan\theta_{min})\cdot\cos\theta_{min}, \text{ and}$$

$$b_2=(P_x\cos\theta_{min}-(P_y-h_o-R\sin\theta_{min})\cdot\sin\theta_{min},$$

where $P_x$ and $P_y$ indicate an x-ordinate and y-ordinate of a fulcrum of said connecting pin element, respectively when the X- and Y- ordinate system is set to lie in a cross sectional plane and has an x-axis extending along an end face of said cylinder block means and an y-axis extending along the center axis of said drive shaft means; $h_o$ indicates a y-ordinate of an acting point with a reaction force of the compression operation of said piston means; R indicates the distance between a wobbling center of said swash plate means and said acting point; L indicates the distance between the wobbling center of said swash plate means and a center line of said connecting pin element along a line vertically extending from said wobbling center of said swash plate to the face of said swash plate means; $\theta_{max}$ indicates the maximum value of an angle of inclination of said swash plate means, and $\theta_{min}$ indicates the minimum value of an angle of inclination of said swash plate means.

* * * * *

UNITED STATES PATENT AND TRADEMARK OFFICE

CERTIFICATE OF CORRECTION

PATENT NO. : 5,316,446

DATED : May 31, 1994

INVENTOR(S) : K. Kimura et al

It is certified that error appears in the above-identified patent and that said Letters Patent is hereby corrected as shown below:

Column 4, line 25, "106" should read --10c--.

Column 8, line 11, after "BP" (first occurrence) "an" should read --tan--; line 44, after $b_1$ change the dash "-" to an equal sign -- = --.

Column 10, line 6, "$h_0$" should read --$h_3$--.

Column 13, line 26, "and" should read --said--; line 52, "$\alpha$[," should read --"$\alpha$",--; line 67 "indicates" should read --indicate--.

Column 14, line 14, delete "means and a center line of said" delete entire lines 15, 16; line 17 delete "plate"; line 29 "mean" should read --means--.

Signed and Sealed this

Twentieth Day of December, 1994

*Attest:*

Bruce Lehman

BRUCE LEHMAN

*Attesting Officer*

*Commissioner of Patents and Trademarks*